US005522516A

United States Patent [19]

Duggal et al.

[11] Patent Number: 5,522,516

[45] Date of Patent: Jun. 4, 1996

[54] LIQUID FLOW CONTROLLING DEVICE

[75] Inventors: Gurpinder Duggal; Rakeshwar Sachathamakul, both of Bangkok, THX

[73] Assignee: Mother's Love Pte. Ltd., Singapore

[21] Appl. No.: 296,114

[22] Filed: Aug. 25, 1994

[51] Int. Cl.[6] ..... A61J 9/00

[52] U.S. Cl. ..... 215/11.4; 222/547; 251/6; 251/250

[58] Field of Search ..... 215/11.4, 11.1; 222/547, 559, 568; 251/6, 8, 9, 250, 7

[56] References Cited

U.S. PATENT DOCUMENTS

| | | | |
|---|---|---|---|
| 244,181 | 7/1881 | Carpenter | 215/11.4 |
| 3,612,474 | 10/1971 | Strohl, Jr. | 251/9 |
| 4,285,492 | 8/1981 | Bujan | 251/6 X |
| 4,301,934 | 11/1981 | Forestal | 215/11.4 |
| 4,911,399 | 3/1990 | Green | 251/6 |
| 4,969,564 | 11/1990 | Cohen et al. | 215/11.4 X |
| 4,994,076 | 2/1991 | Guss | 215/11.4 X |
| 5,318,546 | 6/1994 | Bierman | 251/6 X |

*Primary Examiner*—Allan N. Shoap
*Assistant Examiner*—Christopher J. McDonald
*Attorney, Agent, or Firm*—McAulay Fisher Nissen Goldberg & Kiel

[57] ABSTRACT

A liquid flow control attachment for a baby nurser to control flow of liquid contents contained in the baby nurser to a nipple adapted to be sucked on by an individual, having a self contained attachment unit with one end adapted to be connected to the baby nurser and another end adapted to be connected to a nipple, a colic control mechanism associated with the one end adapted to receive the liquid from the baby nurser and transfer it to the other end; a washer associated with the other end for transferring the liquid from the baby nurser to the nipple, and a flow rate control comprising a liquid path coupling the colic control mechanism with the washer, and an adjuster associated with the liquid path for adjustment thereof for controlling the quantity of liquid passing from the baby nurser to the nipple.

20 Claims, 5 Drawing Sheets

LIQUID FLOW CONTROLLING DEVICE

BACKGROUND OF THE INVENTION

1. Field of the Invention

This invention is concerned with a liquid flow control for a baby nurser or other liquid dispenser.

More particularly, the liquid flow control device of the invention is concerned with an attachment which is constructed so that it can be used in connection with standard baby nipples and standard baby nursers to control the quantity of the flow of the liquid contained in standard baby nursers and control air entry into the nipple and as a part of the liquid feed.

2. Description of the Prior Art

The prior art provides for a conventional baby bottle and baby nurser. In conventional nursing bottles, the content of the bottle is thrust down to the nipple opening and thereby makes the flow constant. This may result in a baby spitting up, swallowing an excess amount of air or even choking while glutting or gagging on the excess supply.

SUMMARY OF THE INVENTION

The attachment is formed from a suitable plastic material which is human safe and is provided with a first portion which can be connected to the conventional baby nurser and preferably be screwed onto and tightened to the mouth of any standard baby nursing bottle. Also, since there is the possibility that the mouth or opening of a conventional baby nurser can have slightly different dimensions, an entry portion for the attachment can be provided with some elasticity so that it will fit the mouth of different conventional baby nursers. While there may be some variation in mouth sizes from different manufacturers, in effect, by providing elasticity for the attachment, the attachment is adaptable to grip onto many different baby bottles or conventional baby nursers.

Once the attachment is screwed tightly onto a regular baby nurser, it can be used like a normal bottle or baby nurser. One end of the attachment is provided with the appropriate screw attachment or connection portion. The other end of the attachment is provided with a mouth portion for receiving a conventional nipple cap and nipple.

One feature of the invention is a liquid rate of flow control mechanism or liquid flow control device forming part of the attachment for controlling the quantity of flow of the liquid during a given time period, with the capability of adjustment of the flow rate externally of the attachment.

A further feature is the provision of a closure mechanism forming part of the attachment and which is coupled with the flow rate controller. The closure mechanism fits into the baby nurser container portion and within the confines of the mouth area of the baby nurser container when the attachment covers the mouth areas of the baby nurser. The closure mechanism includes the cover of the mouth of the baby nurser to control the entry of air and prevent entry of possible contaminants into the baby nurser and a roof portion having an exit opening. The roof portion, while having an opening into the flow rate control, also provides for a place or volume into which air is moved back into the closure mechanism.

The closure mechanism forming part of the attachment for the conventional bottle includes a cover having liquid entry means to guide liquid flow. The liquid flows through this closure device which includes the cover for the opening of the baby bottle's mouth and having a portion extending into the mouth and having entry means for liquid to flow through so that the liquid is properly guided and to assist the flow to help curb colic or a colicky condition in a baby or infant by controlling air entry into the nipple.

In one embodiment of the closure mechanism, the cover extends into the mouth of the bottle, and an opening is provided at the bottom of a base portion. In another embodiment, the base portion is provided with a pair of oppositely disposed openings on the sides with the bottom of the base being solid and presenting a solid face within the mouth of the baby nurser. In still another embodiment, the closure device has an entrance way portion which extends into the mouth of the baby nurser.

The closure device helps to reduce colic and is designed in one embodiment with a smaller opening in the form of a cut or slits on each side of the cover to eliminate some or reduce air bubbles and also acts as a filter as the opening is made small in the form of cuts. Instead of the slits, in another embodiment the opening at the bottom of the base is used to help to reduce colic. A further modification of this embodiment includes the entrance way which extends into the neck or mouth of the baby nurser. This part is made as two units so that it can be disassembled for sterilization or cleaning purposes.

Normally, when a baby or someone else uses an infant nurser, the liquid will tend to flow into the nipple from the nurser. By controlling initially the quantity of flow of liquid into the nipple from the nurser, and the fact that air bubbles will move in an opposite direction from the liquid flow and towards the closure mechanism, helps to prevent the ingestion of air bubbles by the nursing individual.

Knowing for a fact that air in present in the liquid/content and in the nurser bottle itself, expanse of normal nursers allows the liquid to gush directly into the nipple; thus, an infant may usually swallow excessive air from the nurser. Because pressure is exerted on the nipple due to a constant gushy flow, and the infant apparently would have to keep sucking and, while the infant or user does this, either they tend to swallow a lot of air or spit up, or may even choke.

The flow rate adjustor of the attachment is provided with an adjustment or variation mechanism which is associated with a central tube having one end coupled with the closure mechanism and its other end opening into the nipple to vary the internal diameter from a condition of maximum flow to a condition of minimum flow or to a condition of no flow so that various incremental flow openings between the two extreme positions are provided. For this purpose, the exit opening in the roof is connected with the tube, and the exit opening opens into the tube passing through the adjustment mechanism and then the tube passes through a silicon washer which separates the direct flow into the nipple and closes off the exit opening of the attachment and finally the liquid in the baby nurser exits directly into the nipple. The liquid is caused to flow through the tube upon the application of suction to the tube and the closure mechanism from the user of the nipple.

The tube feeds liquid fed thereto from the closure device which has the liquid from the baby nurser supplied either through the opening in the base or the pair of side openings.

Another feature of the invention is the provision of the adjustment mechanism which is a circular flow control knob having a circular threaded or gear member which when turned clockwise will tighten on the thread of a tube surround member surrounding the tube, thus forcing the various parts of the tube surround member to come together or come closer together to squeeze the central tube and decrease the internal diameter of the tube. Accordingly, by rotating or turning the flow control knob in a clockwise direction, it will decrease or shut off the flow, depending on the axial movement of the flow control knob. When flow is shut off or the tube has its diameter decreased and the tube is in its minimum flow condition or is in a no flow condition, and then the knob is gradually turned in the opposite direction, flow will either commence or be increased because the tube diameter is increased and the control tube will slowly release the liquid and as the surround member gripping or pressed against the tube is decreased by turning the control knob in a counter clockwise direction. The rate of flow is increased and eventually complete flow is allowed to pass through the nipple from the tube opening at the adjusted rate.

As the liquid is poured or flows into the nipple from the tube opening at an adjusted rate and in response to suction applied to the nipple, the liquid maintains a certain level in the nipple itself creating an air-pocket while still maintaining the flow of liquid into the nipple.

The air-pocket somewhat restricts and prevents more drops of liquid from falling into or entering into the nipple until such time as the infant acts on the nipple in order to suck thereon and increase the suction applied to the tube and to replenish the consumed amount of liquid from the nipple. More liquid is then allowed into the nipple if the suction by the infant is rapid and the flow will be maintained accordingly. If the flow rate is too great then the flow must be further adjusted to suit the flow for the particular user.

The liquid has to pass through a narrow channel such as the opening in a lower part of the closure mechanism which is connected between the exit end of the nurser and the central tube and then pass through the central tube, and air bubbles are pushed up towards the closure mechanism towards the tube while allowing the liquid to flow from the closure mechanism through the central tube to the nipple end. Therefore, air bubbles are effectively removed and are not absorbed or taken in by the baby. With the removal of or at least a decrease in the quantity of air bubbles, it is possible to reduce the cause of colic in a baby.

Accordingly, another feature of the invention is the reduction or removal of air bubbles which in effect can produce colic in a baby.

The adjuster mechanism also cooperates with the closure mechanism to restrict the flow of liquid as well as increase the rate of return flow of bubbles in the central tube and into the colic and closure mechanism.

This air pocket is created only when flow rate is selected or adjusted to a slower rate. Since the intake of the infant (user) is slow, the level of the liquid accumulated in the nipple should be maintained to suit the sucking rate of the user.

The air pocket, it is believed, helps to apply resistance to any further flow from the central tube opening in the nipple until such time that the infant (user) applies pressure on the nipple in order to suck out the contents. When this pressure is applied on the nipple to suck the liquid out, the balance level of liquid, covering the nipple opening, will prevent the air from escaping through the nipple opening so that the only route left for the air to move is in the upward direction, i.e., in the tube in a direction opposite to the liquid flow (assuming that the bottle nurser is inverted so that the nursing liquid flows in a downward direction towards the nursing individual), displacing the liquid slightly. The liquid flows through the tube into the nipple, and the air is caused to flow in a direction opposite to the liquid flow so that, if the liquid is flowing in a downward direction to the nipple, the air flows in an opposite direction towards the liquid container and into the colic control mechanism, which is also a closure mechanism for the liquid container.

The sucking action on the nipple is a squeeze action and release action, so that at the time of the squeeze action, the air is pushed up towards the colic or closure mechanism, and on release, the air falls back in the nipple together with more liquid to replenish and fill up the level of the liquid in the nipple. Now if, during this use, the infant (user) grows hungry and increases the speed of sucking, each time the air is pushed up towards the colic and closure mechanism, the flow of liquid will increase as well, resulting in increasing the level of liquid in the nipple, until it is completely filled and now the flow depends on the user as to how fast the user consumes the liquid.

Excessive intake of air also happens when the infant has to swallow or ingest the liquid from a constant flowing action from a standard conventional nurser. This again can be prevented by controlling the flow.

The adjuster mechanism of the second embodiment is also combined with the colic and closure mechanism and works and operates in the same manner as described, and also works in a somewhat similar fashion to that of the first embodiment but, in this embodiment, the control mechanism includes a rack and pinion combination in which the rack is a flexible member associated with the central tube and the pinion which is in gear teeth control and association therewith exerts pressure onto the rack to narrow the opening of the tube or enlarge the tube opening as the pinion moves back and forth, respectively, in a direction substantially axially relative to the central tube, on a fixed guide and the rack-type member restricts the flow by squeezing the tube from a broader to a narrower side of the groove and thereby decrease the diameter of the central tube, or vice versa and enlarges the central tube opening.

Another feature of the invention is to control the flow of milk or any liquid through the baby nurser by adding the unique attachment to any nursing bottle.

As indicated heretofore, this attachment helps to prevent choking by controlling the rate of flow of the liquid.

DESCRIPTION OF THE PREFERRED EMBODIMENTS

Figure 1:
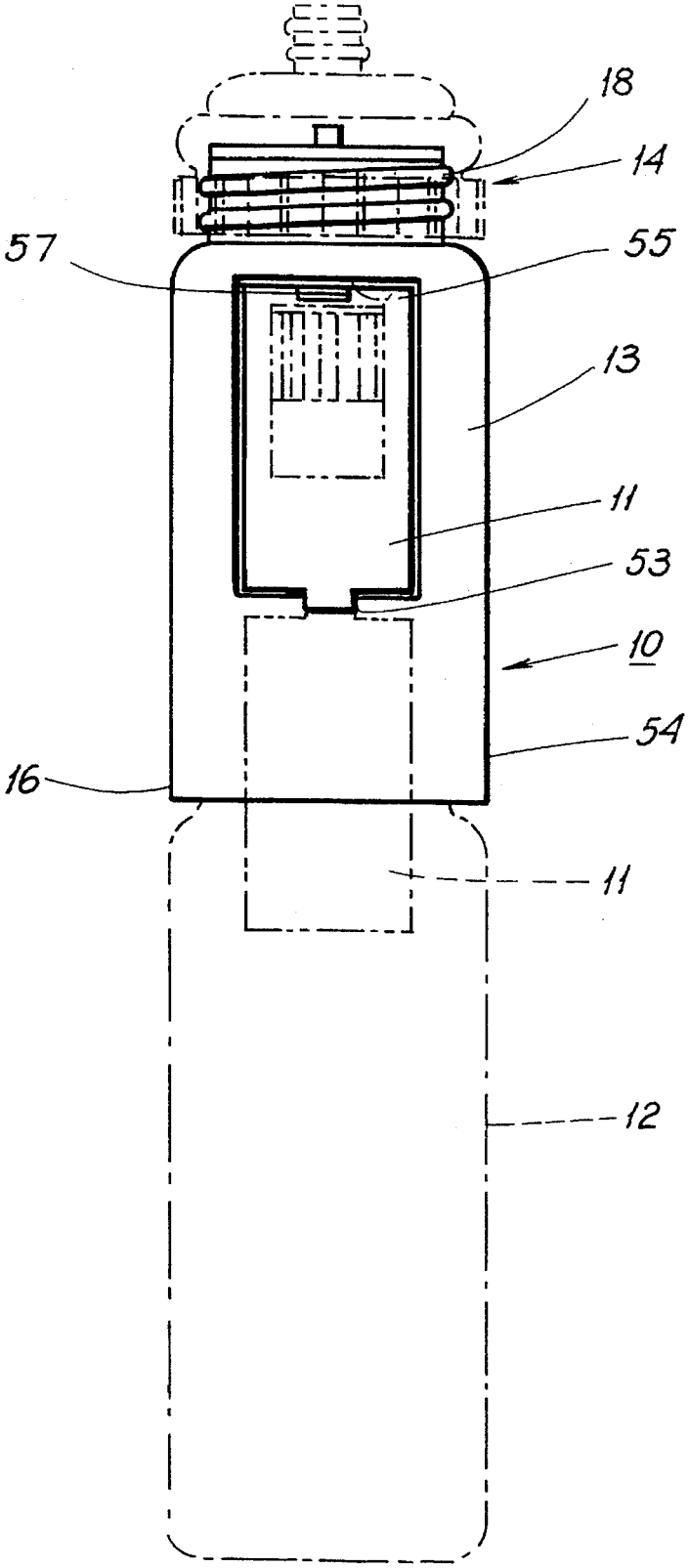
FIG. 1 is a front view of a liquid flow control in accordance with the invention illustrating one embodiment of a liquid flow control device and a closure mechanism which is to be interposed between a conventional baby bottle nurser, shown in dashed outline, and a conventional nipple holder for a nipple, also shown in dashed outline.

Referring now to the drawings and more particularly to FIGS. 1 to 5 and 11 of the accompanying drawings which shows an attachment 10 for regulating the control of the flow of liquid from a nurser 12 which is permitted to flow into a nipple arrangement 14. The attachment is provided with an entrance end 16 for coupling to the mouth of the conventional nurser and an exit end 18 for coupling to the nipple arrangement 14. A closure 11 is provided for access to interior controls. Closure 11 shown in dot-dashed outline indicates its open condition.

Figure 2:
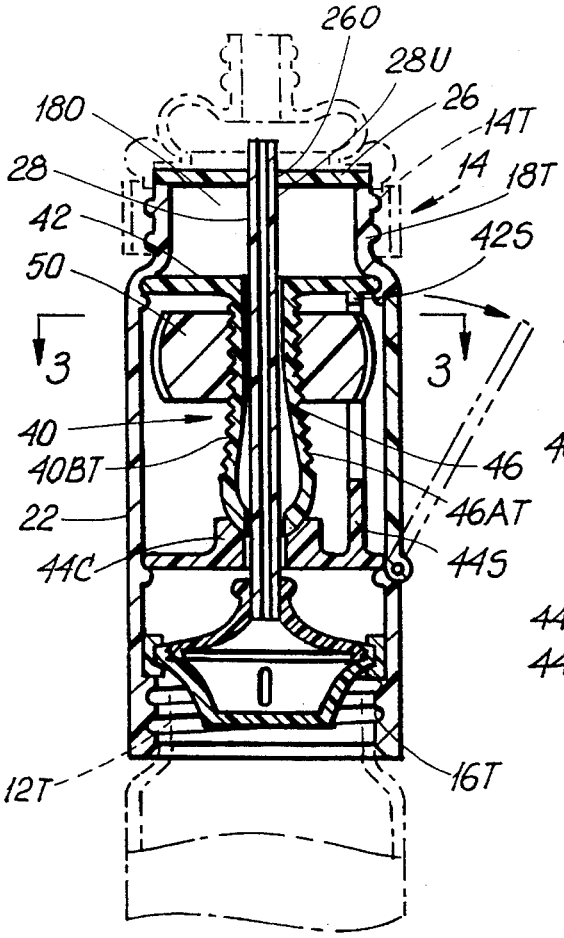
FIG. 2 is a longitudinal sectional view of one embodiment of the liquid flow control device and the closure mechanism of FIG. 1, illustrating the adjustment knob in one extreme position thereof providing for maximum flow of liquid from the conventional nurser, and with an access member shown in dot-dashed outline opened to show access to the adjustment knob.
Figure 4:
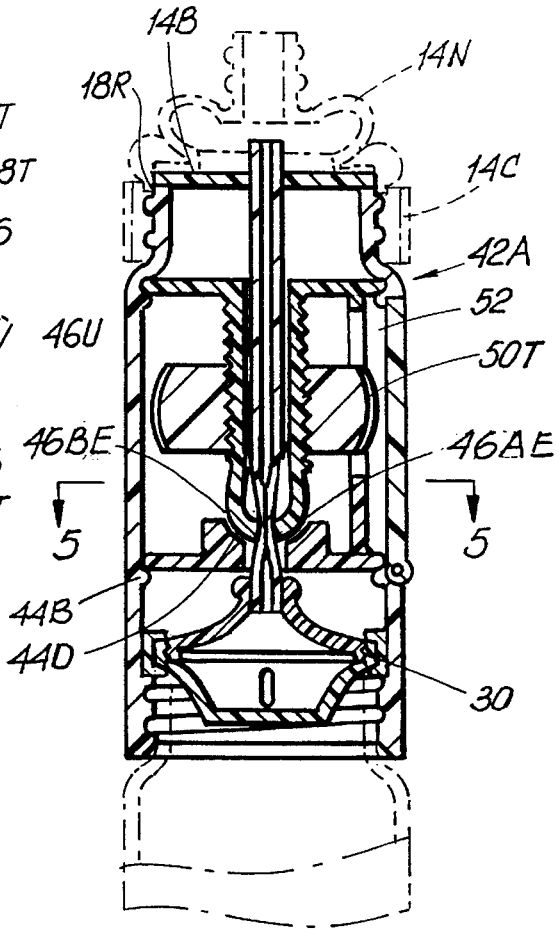
FIG. 4 is another longitudinal sectional view of the first embodiment of the liquid flow control device and the closure mechanism illustrating the adjustment knob in another extreme position thereof providing for a minimum flow.
Figure 3:
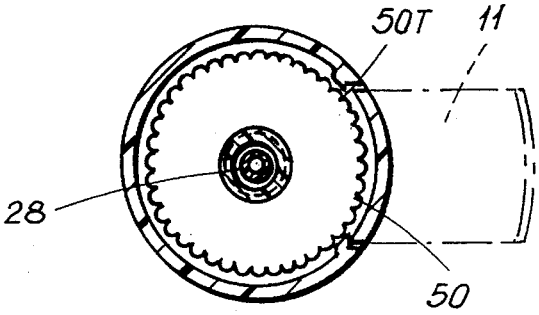
FIG. 3 is a sectional view taken on line 3—3 of FIG. 2, also showing the access member in dot-dashed lines in its open position.
Figure 5:
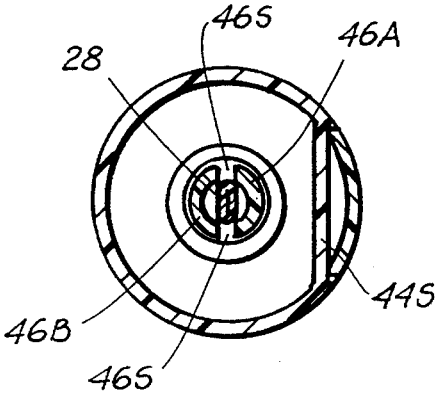
FIG. 5 is a sectional view taken along line 5—5 of FIG. 4.

The attachment 10 comprises a side wall 22, as best seen in FIG. 2, formed of readily available conventional non-toxic and unbreakable plastic material, such as polyethylene, having a substantial rigidity for maintaining its shape while having flexibility at its extreme entrance end 16 for attachment to outer threads 12T of the conventional nurser 12. Attachment 10 is provided with inner threads 16T at entrance end 16 for threaded engagement with threads 12T. At its exit end 18, the attachment 10 is provided with an outer threaded portion 18T for engagement with inner threads 14T of nipple 14.

The exit end 18 of attachment 10 is provided with a silicon washer 26 having a substantially central opening 26O. Silicon washer 26 overlies opening 18O at the exit end 18 and, when the cap 14C of nipple arrangement 14 is screwed onto exit end 18, silicon washer 26 is held tightly against top rim 18R of exit end 18. Silicon washer 26 is provided to ensure a tight fit between attachment 10 and the baby nipple 14N with a base portion 14B of the nipple sandwiched between washer 26 and the cover of the nipple arrangement 14. The silicon washer is received on top of the exit end 18 of the attachment 10 and fits over a central tube 28. The outer peripheral portion of tube 28 and the central opening 26O of the silicon washer 26 are such that washer 26 is not press fitted onto tube 28 but is tightly held thereon so that it will properly position the tube within the attachment while having some movement longitudinally along tube 28. While washer 26 has some slight adjustment or movement along tube 28, once the nipple holder is screwed onto the attachment, a tight fit and closure is provided between the attachment and the nipple. The upper end 28U of tube 28 passes through the washer 26 and extends into the nipple.

A flow liquid entrance colic control or control mechanism 30 is provided at the entrance end 16 for coupling with the nurser 12 and control tube 28. The specific details of this feature and the various embodiments are described in detail in connection with FIGS. 11 to 14.

The flow liquid entrance colic control or control mechanism acts as a closure to close off the mouth of the nurser 12, and comprises an upper member 30U and a lower member 30L which can be coupled together and separated from each other for cleaning purposes. For a detailed showing and discussion of the closures, reference is made to FIGS. 11 to 14. The lower member 30L includes a substantially closed flat base 32 having a substantially cylindrically-shaped side portion 33 having at least one oval or elongated opening 34, and preferably two diametrically opposed openings 34. These openings are preferred to have a width dimension of ⅛ inch to 1/16 inch and length extent of about ¼ to ½ inch. While these are the preferred dimensions, other variations may also be used, so long as the liquid flow in one direction does not prevent air bubbles from moving in the opposite direction.

The upper member 30U includes a roof portion 35 having a central opening 35O and a base 35B provided with outer threads 35T which contacts the top 36T of lower portion 32L. The lower end of the tube 28 extends into roof portion 35 through opening 35O. Portion 36 is the connection between top or upper member 30U and bottom or lower member 30L to form the outer portion of 36 which is received within an inner circumferentially-shaped U-shaped member 38 forming part of the lower inner wall of entrance end 16.

Figure 11:
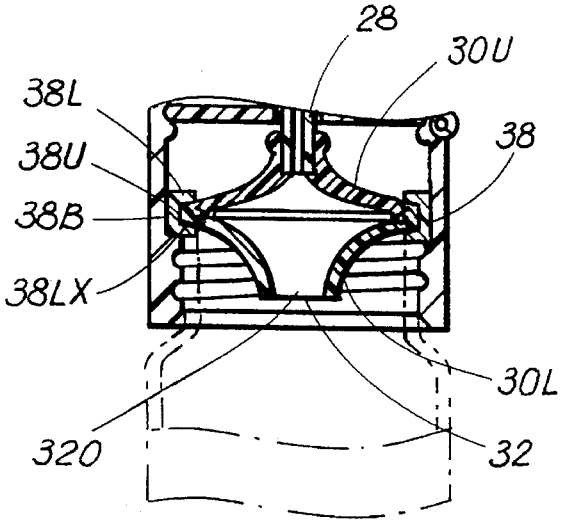
FIG. 11 is a partial sectional view showing a flow liquid entrance colic control or control mechanism similar to that of the lower portions having the closure mechanism of the attachments of FIGS. 2 and 7, showing another embodiment of the closure mechanism shown in FIGS. 1 to 10 illustrating a modification of a portion of the closure mechanism for cooperation with the mouth of the nurser, and illustrating the cover with an opening in the base and not the sides as shown in FIGS. 2 and 7.

U-shaped member 38, see FIG. 11, includes an inner U-shaped portion 38U having two legs 38L, 38LX and a base 38B within which outer portion 36 is fitably received for alignment with the mouth of the nurser 12. Outer portion 36 is configured to be press-fitted within U-shaped member 38 for retention therein, but there is sufficient elasticity between outer portion 36 and U-shaped member 38 so that they can be separated, if necessary, for cleaning and sterilization purposes. All three embodiments are preferably held in place by U-shaped member 38, and the vertical extension of 30L' of the FIG. 13 embodiment is also held and located by means of U-shaped member 38.

A flow control device 40 comprising a pair of spaced guide and locating members 42 and 44, each having a central opening 42O and 44O for receiving the flexible tube 28 and through each of which the flexible tube passes, is formed of flexible material, and having an adjustable and variable inner diameter. Upper locating member 42 is received within U-shaped portion 42A formed by a substantially curved portion defining the U-shaped portion having a lower inner circumferentially extending portion forming one leg 42B and upper inner curved portion 42C forming the other leg of the U-shaped inner receiving portion.

Upper locating member 42 is substantially disc shaped and has its outer edge received within U-shaped portion 42A and is press-fitted therein. Depending from upper locating member 42 and substantially surrounding tube 28 is a flexible tube closure member 46 having its upper circular end 46U connected with locating member 42 and a pair of substantially semi-circular lower portions 46A and 46B separated at the lower ends by a pair of partially longitudinal slits 46S. The lower ends 46AE and 46BE terminate at free ends which are positioned against the outside of tube 28 on the outer periphery thereof and cooperate with lower locating member 44.

Figure 7:
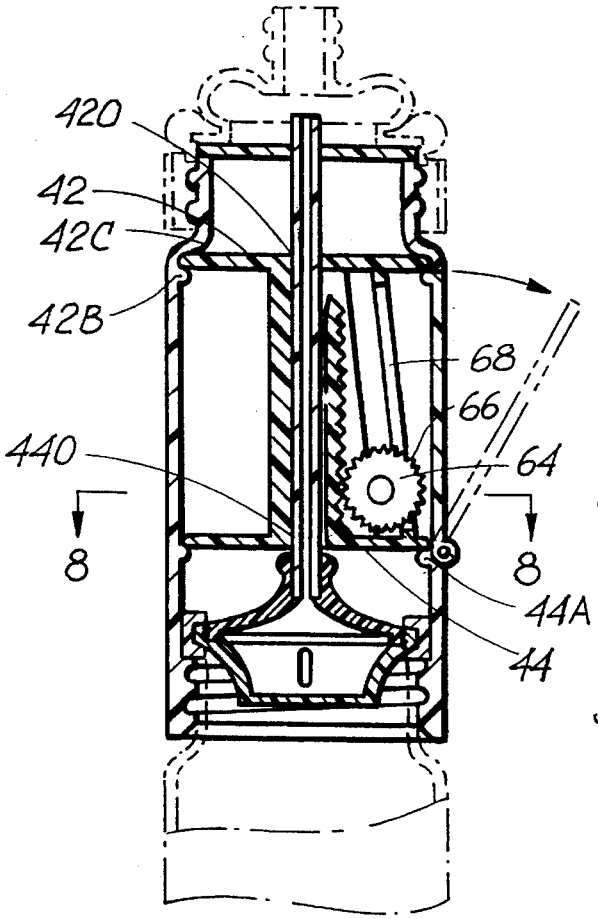
FIG. 7 is a longitudinal sectional view of the liquid flow control of FIG. 6 illustrating a modification of the flow control device of the FIGS. 1 to 5 embodiment shown in one extreme position thereof for maximum flow of liquid from the nurser to the nipple, and the same embodiment of the closure mechanism shown in FIGS. 1 to 5, both the nurser and the nipple being shown in dot-dashed outline.
Figure 9:
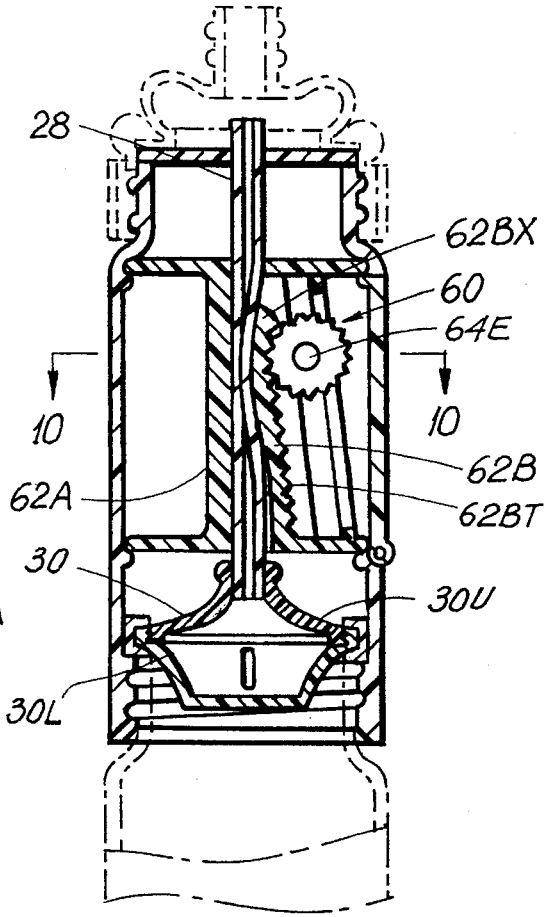
FIG. 9 is a longitudinal sectional view similar to that of FIG. 7, but showing the flow control adjuster in its position of complete flow cut-off for no flow of liquid from the nurser through the central opening.
Figure 8:
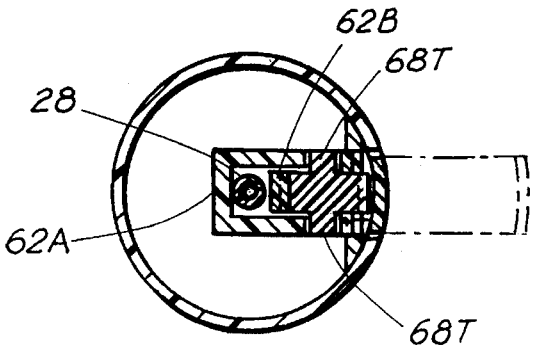
FIG. 8 is a sectional view taken on line 8—8 of FIG. 7 showing the fully unobstructed flow and the flow opening.
Figure 10:
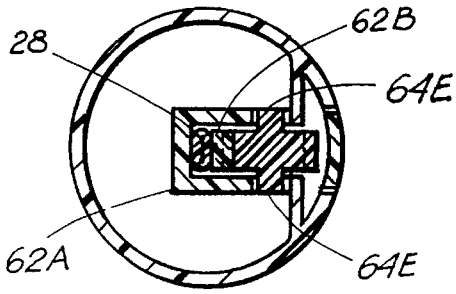
FIG. 10 is a sectional view taken on line 10—10 of FIG. 9.

Lower locating member 44 can be positioned on ledge 44A or received within a U-shaped portion 44B, as best seen in FIGS. 7 and 9. Both receiving portions 44A and 44B will be useful in the positioning of locating member 44.

Lower locating member 44 is also a substantially circular disc shaped member having the central opening 44O through which tube 28 passes for entry into opening 35O. Lower locating member 44 is provided with a bushing type portion 44C having central cup-shaped portion 44D to receiving the two separate ends of lower portions 46A and 46B. The cup-shaped portion 44D has a convex shaped configuration to receive the lower portions 46A and 46B, which have a concave shape and can be moved together to close off tube 28 at a position substantially adjacent to bushing 44C.

Projecting upwardly from lower locating member 44 is a limit stop 44S which cooperates with a limit stop 42S projecting downwardly from upper locating member 42 for controlling the extent of movement of adjustment knob 50. Access to adjustment knob 50 is through a door opening 52 which is closed by closure 11 which is pivotally connected at pivot connection 53 with outer wall 54 of attachment 10. A locking mechanism 55 is provided to lock closure 11 with the outer wall 13 of attachment 10. Handle 57 is provided to manipulate.

Coupled with or extending from upper locating member 42 at the lower end thereof is flexible tube closure member 46 surrounding tube 28 and in effect forming a plurality of a pair of opposed flap members 46A and 46B each having on an outer portion thereof a threaded portion 46AT and 46BT. The lower portions 46A and 46B of closure of closure member 46 are bulged outwardly so that, as knob 50 moves from its position adjacent to the upper locating member 42 to the lower locating member 44, the tube 28 has its internal diameter decreased until it is closed off. At a position towards the upper locating member 42, flexible tube enclosure member 46 is substantially a cylindrical member with an outer threaded portion 46T, and after closure member 46 is separated into at least two flap-type members 46A and 46B, these members are also provided with outer threaded portions 46AT and 46BT, forming the convex portion of cup-shaped portion 44D. Ends 46AE and 46BE are received within the undercut portion 58 which forms a semi-hollow portion having the central opening 44O which is axially aligned with central opening 42O.

Knob 50 has internal threads 50T which mate with the threads on closure member 46 for moving the flap-type members 46A and 46B together to close-off or constrict tube 28 to control the flow of liquid therethrough.

Referring now more particularly to FIGS. 6 to 10 which illustrate another embodiment for reducing the size of the tube 28. In this embodiment, like parts will be provided with the same reference numerals.

The adjustment mechanism 60 generally includes a first U-shaped wall member 62A connected between and joining upper and lower members 42 and 44, respectively, and a second flexible wall member 62B extending upwardly from lower member 44 and having on an outer portion thereof a rack of gear teeth 62BT. While wall member 62B is shown as being connected at solely one end to lower member 44, and its other end 62BX as a free end, if greater rigidity is required, it can have other end 62BX connected to upper member 42, and substantially enclose tube 28.

Pinion or knob member 64 is provided having teeth 66 on the outer periphery thereof adapted to mesh with the teeth 62BT on semi-cylindrical member 62B. Guideway 68 is provided which is inclined to provide a decrease in the width of the passageway in tube 28 as flexible wall member is caused to be pressed against flexible tube 28. Guideway 68 includes a pair of spaced tracks 68T, and knob 64 is positioned between the tracks 68. The tracks 68 have a longitudinal axis which is inclined relative to the longitudinal axis of tube 28.

Knob 64 is coupled with guideway 68 by means of extensions 64E which form axles to be guided in oppositely disposed guide tracks 68T of guideway 68 to cause tube 28 to move from its fully open maximum position at its position adjacent to lower member 44, and as knob 64 moves towards the upper member 42, the diameter of tube 28 is decreased and tube 28 is closed off.

Figure 6A:
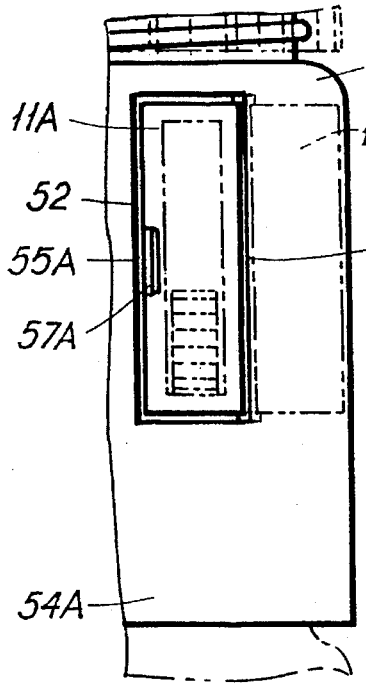
FIG. 6*a* is another modification of the embodiment of FIG. 6 showing a different form of door access to the internal parts of the FIG. 6 embodiment.
Figure 6:
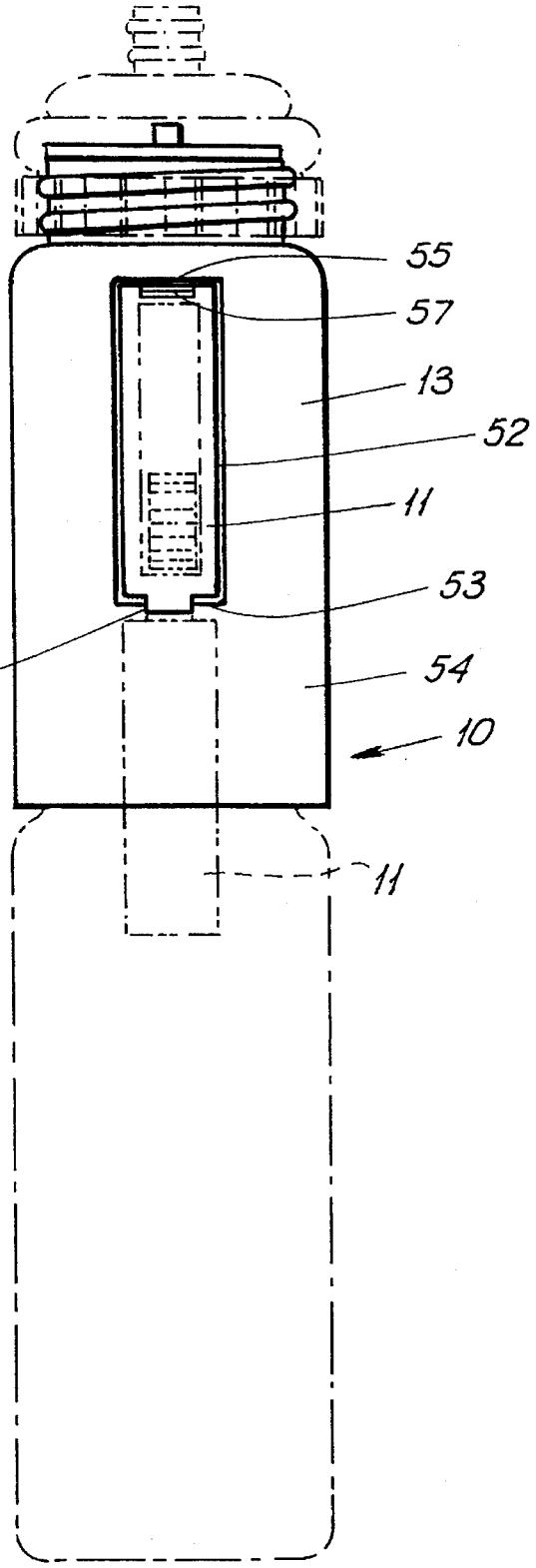
FIG. 6 is a front view of a modification of the liquid flow control of FIG. 1.

In FIG. 6, a different type of door closure is shown which is somewhat smaller than that shown in the FIGS. 1 to 5 embodiment. As the difference is only one of size, the same reference numerals have been used throughout.

In FIG. 6*a*, an alternate embodiment for the door closure 11 is shown. Door closure 11A pivots along an axis 51A which is substantially parallely related to the central axis of the attachment. Corresponding parts have been referenced with the same reference numerals raised with the letter A. In the FIG. 6 embodiment and the FIG. 1 embodiment, the axis 51 about which the door pivots is orthogonal to the central axis of the attachment.

The door or closure 11 has a clip or locking catch to prevent easy access to the adjuster or adjustment knob 50 or adjuster 64, pinion of knob member. Access is provided when the door 11 lid is opened to provide for adjustment for the flow of liquid from the nurser.

Figure 12:
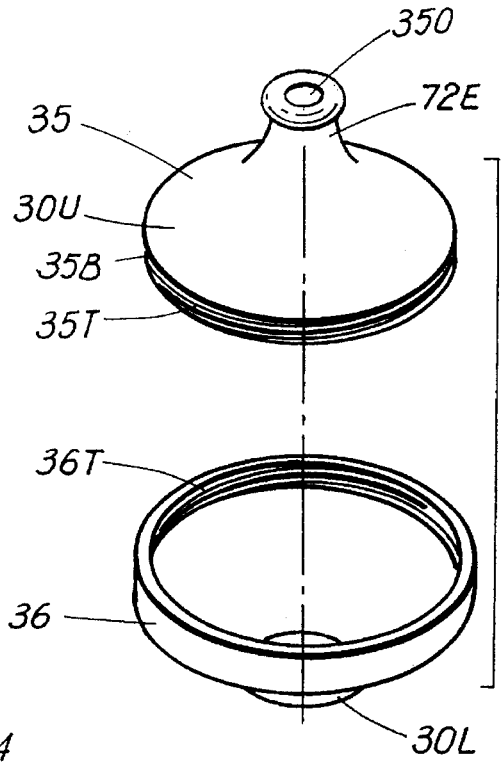
FIG. 12 is an opened view of the closure mechanism acting as the flow liquid entrance colic control or control mechanism of FIG. 11 showing the two main parts separated and as comprising an upper portion for connection with the central flow control tube and a lower or cover portion for coupling with the bottle or container nurser for the suctioning of liquid through the closure mechanism and for alignment with the mouth of the nurser.

Referring now to FIGS. 11 and 12 which shows one embodiment of the lower connector or colic control mechanism 30. In this embodiment, lower connector or member 30L also comprises an upper part 30U having an extension 72E and an outer threaded portion 35T for engagement with a lower part 36 having an inner threaded portion 36T which is adapted to surround the outer threaded portion 35T for connection of upper part 30U and lower part 30L while permitting them to be separated for cleaning purposes. Outer portion 36 has the inner threaded portion 36T which mates with outer threaded portion 35T of upper member or roof portion 30U. The U-shaped member 38 receives outer portion 36 which is press-fitted within 38U between upper leg 38L and lower leg 38LX.

The upper extension 72E is provided with an inner opening 35O to receive tube 28. The lower portion 30L includes a central opening 32O through which liquid from the conventional nurser enters into lower connector 30L for entry into tube 28. Opening 32O is shown as circular, but it may also be oval. Opening 32O has a preferred diameter of approximately one twelfth of an inch to about one quarter of an inch, and a variation of about ten to twenty percent from this figure would be within the preferred range. While the aforesaid range is provided, an area towards the lower figure is further preferred.

Figure 13:
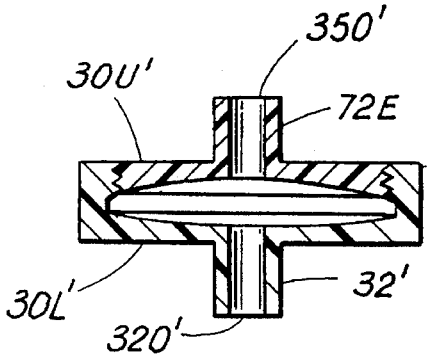
FIG. 13 is a modification of the closure mechanism or colic control mechanism shown in FIG. 12 illustrating the two main parts connected together.

Referring now more particularly to FIG. 13 which is a modification of the colic control mechanism or closure mechanism 30, and similar parts will be designated with the same reference numerals and primed. This embodiment is somewhat more compact than the FIG. 12 embodiment, and its lower part is substantially similar to lower part 36 but somewhat more compact, while providing for closure of the top of the nurser.

Accordingly, upper member 30U' and lower member 30L' are shown connected by any conventional means or, as shown in FIG. 12 by means of internal and external threads, and having an inlet 32' shown as an elongated tube which fits into the mouth of the bottle and an outlet 72E' which is also shown in tubular form which has an opening 35O' to receive tube 28. This modification is somewhat less costly to manufacture than the FIG. 12 embodiment. While the inlet and outlet are shown in tubular form, they can have a different internal area of flow configuration, such as an oval cross-section, so long as the area of flow is maintained.

The total liquid inflow area 32O or 34 preferably varies between approximately 0.005 to 0.0625 square inches. For the inflow area of 32O' of inlet 32', a diameter as low as 1.95 mm can be used and up to a diameter about 4 mm, whether square or round, because of the smaller internal volume, and this is just slightly below the 0.005 square inch area in the inch measurement area of inflow area 32O and 34.

The mating threads 35T and 36T are provided so that upper and lower parts 30U and 30L can be disconnected from each other for the purpose of cleaning as well as to harness and secure its sub-parts.

Figure 14:
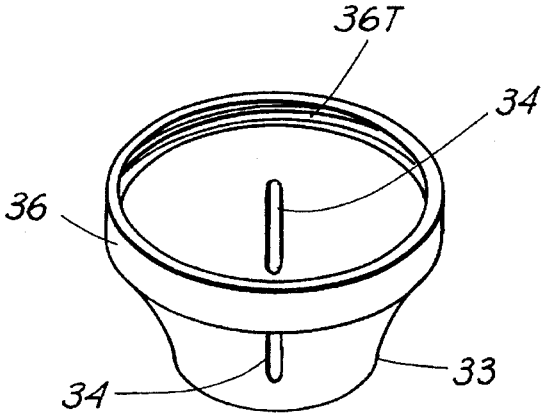
FIG. 14 is a partial view of the cover or bottom portion of the closure mechanism or colic control mechanism shown in FIGS. 11 and 12 and the bottom portion of the closure mechanism shown in FIG. 13, and showing only the lower or cover portions of the embodiment shown in FIGS. 2 and 7 which also performs the function of an alignment mechanism for alignment of the closure mechanism with the mouth of the bottle or container nurser.

In the FIG. 14 embodiment, the base or lower portion forming cover 33 is provided with at least one and preferably two oval or elongated slots 34.

These fine cuts and openings 32O, 32O' and 34 are involved in helping to push the air or air bubbles up and away from the nipple when an individual sucks on the nipple so that the air bubbles move up the control tube 28 as liquid moves down the tube 28 into the nipple.

The fine cuts and openings 32O, 32O' and 34 also help to prevent any contamination of solid particles or clogging lumps to pass through the control tube 28.

It is the narrow passage of these cuts that, it is believed, would prevent the solid particles or clogging lumps from passing through together with the liquid as well as assist in preventing or limiting the quantity of air bubbles from entering the closure mechanism 30. Upon such action as sucking, when the nipple is first squeezed and there is no liquid in the nipple, only the air in the nipple is left out, so that while the air is being pushed out of the nipple, upon squeezing of the nipple, the liquid from the bottle is let all the way in from the roof portion 35 of the nurser. Accordingly, the cuts are effective to prevent clogging of tube 28, assist in colic control, and to enable the liquid to be passed into tube 28 for providing substantially free flowability of the liquid.

Therefore, in order to permit the liquid to pass through, the air rises up to a wider space in the expanse on the inside of the closure mechanism or liquid flow entrance coupled with the exit end of nurser 12. This is seen as the bubbles originating at these cuts and openings 32O, 32O' and 34 eventually are trapped under the roof portion 35. For every air bubble that shoots or moves into tube 28, liquid is caused to move away from the nipple because the same volume of liquid is replaced by the air bubble, i.e., goes down tube 28, as the individual sucks on the nipple. Therefore, it is important that the air bubbles have a place to go, and these go back into the liquid flow entrance mechanism or closure mechanism 30 under the roof portion 35.

The attachment body is preferably opaque so that the contents are not externally visible.

While there has been shown what is considered to be the preferred embodiments of the invention, various changes and modifications may be made without departing from the scope of the invention.

We claim:

1. A liquid flow control for a baby nurser to control the flow of liquid contents contained in a baby nurser to a nipple dispenser adapted to be sucked on by an individual, including a self-contained unit having an entry end and an exit end, spaced axially from each other;

a pair of spaced locating members removably coupled with an inner wall of said self-contained member and each having a central opening;

a flexible tube extending from one end of said member to the other end thereof and passing through said central opening;

a liquid flow entrance mechanism associated with said entry end adapted to be received within the mouth of a baby nurser and having an opening for receiving one end of said flexible tube for applying liquid from said baby nurser to said nipple and providing an exit for the flow of gas bubbles in a direction opposite to the flow of the liquid; and a flexible tube constrictor associated with said flexible tube for varying the internal diameter thereof for controlling the flow of liquid through said flexible tube.

2. The control as claimed in claim 1, wherein said flexible tube constrictor comprises a pair of oppositely disposed flexible members coupled with one of said pair of spaced locating members and maintained in alignment with said tube by the other of said pair of spaced locating members.

3. The control as claimed in claim 2, including a control member accessible externally of said self-contained unit, means on an outer portion of said pair of oppositely disposed flexible members cooperatively associated with said control member for movement of said flexible tube constrictor for varying the internal diameter of said tube.

4. The control of claim 1, wherein said flexible tube constrictor comprises a flexible track and pinion arrangement, and a backing for said flexible tube for compressing said flexible tube to decrease the internal diameter thereof by having said flexible track together with said backing, asserting pressure onto said flexible tube responsive to the movement of said pinion.

5. The control of claim 4, wherein said backing is substantially parallel to a longitudinal axis of said flexible tube, said flexible track being positioned substantially parallel to said longitudinal axis with said flexible tube between said backing and said flexible tube, and a guide for said pinion for movement on said track along a path in a non-parallel direction relative to said longitudinal axis so that the spacing between said backing and said track is changed as said pinion is moved along said guide.

6. The control of claim 1, wherein said liquid flow entrance mechanism has an opening area which varies between approximately 0.005 to 0.0625 square inches communicating with the baby nurser for receiving liquid therefrom, said self-contained unit including a closure for said flexible tube constrictor for preventing access thereto externally of said self-contained unit, means for pivotally connecting said closure to said self-contained unit, and means for locking said closure to said self-contained unit.

7. A liquid flow control attachment for a baby nurser to control flow of liquid contents contained in the baby nurser to a nipple adapted to be sucked on by an individual, comprising self contained attachment unit having one end including means adapted to be connected to the baby nurser and another end including means adapted to be connected to a nipple;

first means associated with said one end adapted to receive the liquid from the baby nurser and transfer it to said other end;

second means associated with said other end for transferring the liquid from the baby nurser to the nipple; and flow rate control means comprising a liquid path coupling said first and second means, and an adjuster associated with said liquid path for controlling the quantity of liquid passing from the baby nurser to the nipple; and said self-contained attachment unit including an outer member containing and enclosing said liquid path, and including access means for closing off said adjuster from the exterior of said self-contained attachment unit, said access means being pivotally connected with said attachment unit for movement from a fully closed position to an open position to provide access to said adjuster.

8. A liquid flow control attachment for a baby nurser to control flow of liquid contents contained in the baby nurser to a nipple adapted to be sucked on by an individual, comprising a self contained attachment unit having one end including means adapted to be connected to the baby nurser and another end including means adapted to be connected to a nipple;

first means associated with said one end adapted to receive the liquid from the baby nurser and transfer it to said other end;

second means associated with said other end for transferring the liquid from the baby nurser to the nipple; and flow rate control means comprising liquid path means coupling said first and second means, an adjuster associated with said liquid path for controlling the quantity of liquid passing from the baby nurser to the nipple; and said first means includes a closure mechanism coupled with said flow rate control means including a first portion fitable within the mouth of the baby nurser and forming a cover for covering the mouth thereof and controlling entry thereinto of air or other possible contaminants into said baby nurser, said cover having at least one opening for entry of liquid from the baby nurser into said closure mechanism and for exiting of air bubbles, and a second portion forming a roof portion associated with said cover, and said flow rate control means includes a tube coupled with said roof for permitting liquid to be removed from said closure mechanism through said tube upon application of suction thereto and for exiting of air bubbles from said tube to said closure mechanism.

9. The attachment unit as claimed in claim 8, wherein said cover is provided with at least one opening on a side thereof beneath an outer rim portion of the baby nurser into which a portion of said closure mechanism fits for providing a liquid entry to guide liquid flow.

10. The attachment unit as claimed in claim 8, wherein said cover has a base provided with an opening beneath an outer rim portion of the baby nurser into which a portion of said closure mechanism fits for providing a liquid entry means to guide liquid flow.

11. The attachment unit as claimed in claim 8, wherein said second means includes a washer for closing off the entry to the nipple from said attachment, said washer having an opening therein for receiving an exit end of said tube for directing the flow of liquid from the baby nurser through said closure mechanism to the nipple.

12. A liquid flow control attachment for a baby nurser to control flow of liquid contents contained in the baby nurser to a nipple adapted to be sucked on by an individual, comprising a self contained attachment unit having one end including means adapted to be connected to the baby nurser and another end including means adapted to be connected to a nipple;

first means associated with said one end adapted to receive the liquid from the baby nurser and transfer it to said other end;

second means associated with said other end for transferring the liquid from the baby nurser to the nipple; and flow rate control means comprising a liquid path means coupling said first and second means, adjuster means associated with said liquid path for controlling the quantity of liquid passing from the baby nurser to the nipple; and closure means associated with said self-contained attachment unit for providing access to said flow rate control means and closing off access externally of said flow rate control means, and locating means at said one end for assuring the location of a closure mechanism at said one end for insertion into a baby nurser.

13. The attachment of claim 12, wherein said closure means includes a door-type entry pivotally coupled with an outer surface of said self-contained attachment unit, and forming a uniformly continuous outer surface therewith, and locking means associated with said outer surface and said door for locking thereof to said outer surface.

14. The attachment as claimed in claim 12, wherein said adjuster means includes a rack and pinion arrangement associated with said liquid path for varying the internal diameter thereof.

15. The attachment as claimed in claim 14, including a central tube for conveying the liquid contents from the baby nurser to the nipple, said central tube having a longitudinal axis, and a track for guiding movement of said pinion between the ends of said mechanism and in contact with said central tube for decreasing the diameter of said tube.

16. The attachment as claimed in claim 15, wherein said track has a longitudinal axis which is not parallel to said tube axis so that the internal diametrical spacing of said tube decreases as said pinion moves from one end to said other end.

17. A liquid flow control attachment for a baby nurser to control flow of liquid contents contained in the baby nurser to a nipple adapted to be sucked on by an individual, comprising a self contained attachment unit having one end including means adapted to be connected to the baby nurser and another end including means adapted to be connected to a nipple;

first means associated with said one end adapted to receive the liquid from the baby nurser and transfer it to said other end;

second means associated with said other end for transferring the liquid from the baby nurser to the nipple; and flow rate control means comprising liquid path means coupling said first and second means, an adjuster associated with said liquid path means for controlling the quantity of liquid passing from the baby nurser to the nipple, and means for closing off access to said adjuster to prevent an undesired change in the control of the quantity of liquid passing from the baby nurser to the nipple.

18. The attachment as claimed in claim 17, wherein said liquid path means includes a tube coupling said first and said second means for conveying liquid therebetween, said flow rate control means including upper and lower locators, said upper locator including a flexible tube closure member depending therefrom and having a pair of lower free ends positioned against the outside of said central tube, said lower locator including means for receiving said pair of lower free ends and maintaining them against said central tube, and said adjuster including a member for movement axially of said flexible tube along said flexible tube closure member to move said pair of lower free ends together to decrease the internal diameter of said flexible tube.

19. The attachment of claim 17, wherein said flow rate control means includes upper and lower locators and means associated with said self-contained attachment unit for maintenance of said upper and lower locators in spaced relationship and being releasable for removal of said upper and lower locators, said upper and lower locators each having a central opening aligned with each other for passage therethrough of said liquid path means.

20. The attachment as claimed in claim 19, including a central tube for conveying the liquid contents from the baby nurser to the nipple, said central tube herring a longitudinal axis, and a track for guiding movement of a pinion between the ends of said mechanism and in contact with said central tube for decreasing the diameter of said tube.

* * * * *